US010947713B2

(12) United States Patent
Schmidt et al.

(10) Patent No.: US 10,947,713 B2
(45) Date of Patent: Mar. 16, 2021

(54) TOILET FLANGE

(71) Applicant: Spray Tech Industries, LLC, Albertville, AL (US)

(72) Inventors: Joshua Kent Schmidt, Albertville, AL (US); Joel Kent Schmidt, Albertville, AL (US); Anthony Mosley, Guntersville, AL (US)

(73) Assignee: Spray Tech Industries, LLC, Arab, AL (US)

( * ) Notice: Subject to any disclaimer, the term of this patent is extended or adjusted under 35 U.S.C. 154(b) by 0 days.

(21) Appl. No.: 16/455,281

(22) Filed: Jun. 27, 2019

(65) Prior Publication Data

US 2020/0407964 A1 Dec. 31, 2020

(51) Int. Cl.
*E03D 11/16* (2006.01)

(52) U.S. Cl.
CPC ..... *E03D 11/16* (2013.01)

(58) Field of Classification Search
CPC ..... E03D 11/16
USPC ..... 4/251.2, 252.1–252.2
See application file for complete search history.

(56) References Cited

U.S. PATENT DOCUMENTS

2013/0305443 A1* 11/2013 Baranj ..... E03D 11/16
4/251.1

* cited by examiner

*Primary Examiner* — Christine J Skubinna
(74) *Attorney, Agent, or Firm* — Dennen IP Law, LLC

(57) ABSTRACT

A toilet flange has a hub configured to couple to a pipe on a first end, the hub having an inner circular wall forming a cylindrical channel and having at least one opening and a hub flange coupled to the hub on a second end, the flange having a reservoir for collecting liquid, the flange further configured to dump the liquid from the reservoir into the cylindrical channel through the opening.

14 Claims, 2 Drawing Sheets

TOILET FLANGE

BACKGROUND

A commode has a number of parts that allow the commode to function. For example, a commode has a tank that stores water that is provided to a bowl to refill the bowl when the commode is flushed. From the bowl extends a trap way through which the contents of the bowl flow when the commode is flushed.

The bottom of the commode comprises an opening that is coupled to a pipe through which the contents of the bowl flow when the commode is flushed. Typically, the commode is coupled to a floor via a toilet flange. The toilet flange, also known as a toilet flange, is a pipe fitting. In this regard, the toilet flange both mounts onto the underside of the commode where the opening on the commode is located and the floor. Further, the toilet flange is coupled to a pipe. The toilet flange directs the contents of the bowl to the pipe when the commode is flushed.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure describes a toilet flange that interferes with leakage and alerts a user to the leakage that may occur between a commode and a toilet flange. The toilet flange of the present disclosure comprises a hub flange and a cylindrical, open hub that is coupled to the hub flange that extends radially from the cylindrical, open hub. In use, the hub flange couples to an opening on the floor, and the cylindrical, open hub couples to a drain pipe.

A toilet flange in accordance with an embodiment of the present disclosure comprises a conduit on a top surface of the hub flange that encircles the hub flange. This circular conduit leads to a reservoir within the hub flange that extends completely around the hub flange. The reservoir is in fluid communication with at least one angularly and downwardly positioned channel relative to the top of the hub flange. Thus, water can flow through the opening on the top surface of the flange, through the reservoir, through the channel, and into a pipe to which the hub is coupled. Note that a moisture indicator may be used on the circular opening on the top of the hub flange to alert users to a leak.

Figure 1:
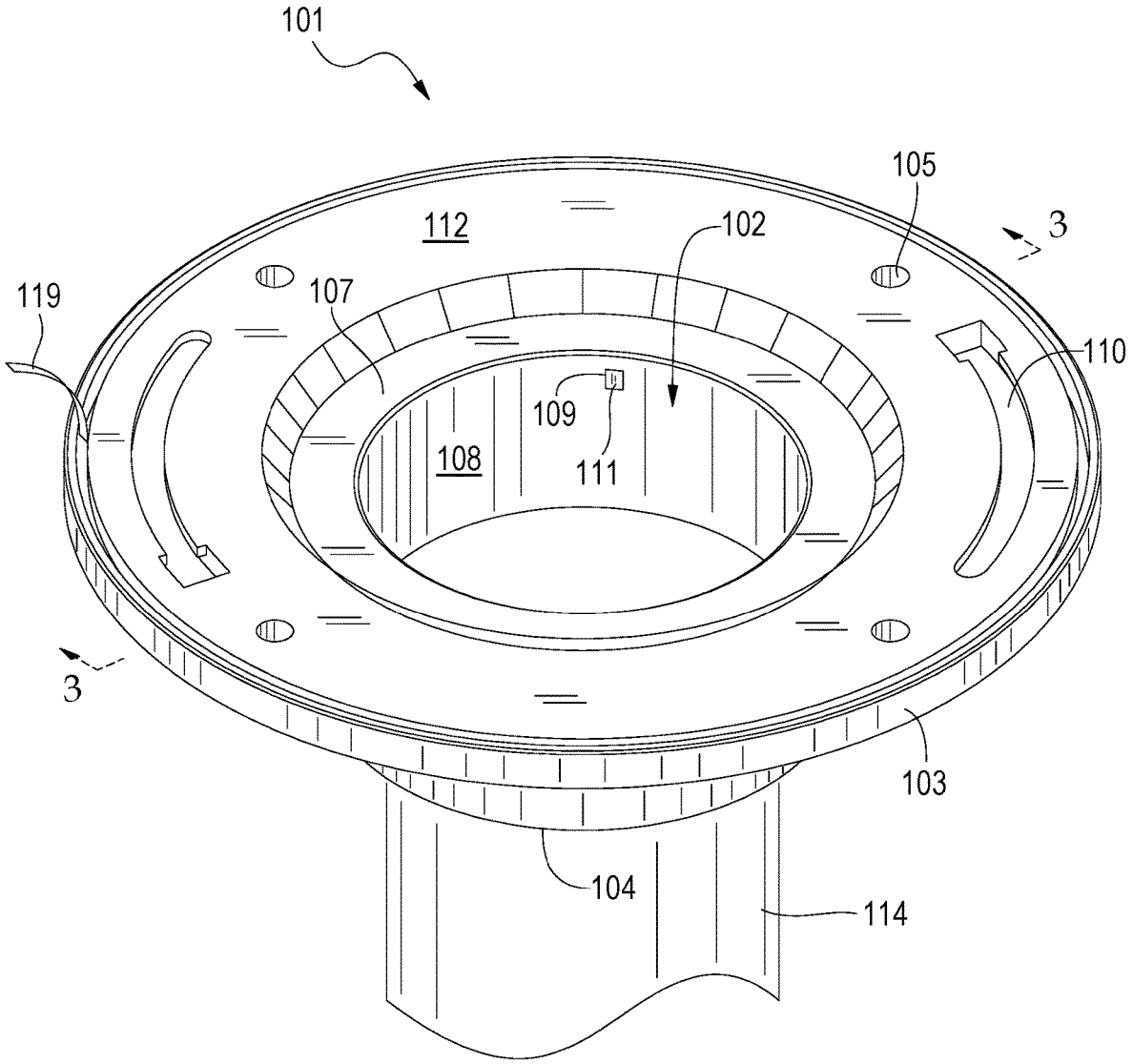
FIG. 1. Is a perspective view of a toilet flange in accordance with an embodiment of the present disclosure.

FIG. 1 is a perspective view of a toilet flange 101 in accordance with an embodiment of the present disclosure. The toilet flange 101 comprises a cylindrical, open hub 104 with a circular cross-section that is configured to couple to a pipe 114. The pipe 114 facilitates draining the toilet bowl of a commode (not shown) when the commode is flushed. The cylindrical, open hub 104 is open on both the top and the bottom of the cylinder, therefore the cylindrical, open hub 104 has a cylindrical wall 108 forming exit channel 102 through which waste can flow from the toilet bowl.

Additionally, the toilet flange 101 comprises a hub flange 103. In one embodiment, the hub flange 103 is circular. The hub flange 103 couples to or is integral with the cylindrical, open hub 104. The hub flange 103 is configured to be coupled to a floor (not shown) and to the underside of the commode. In this regard, there are a plurality of openings 105 for receiving fasteners on the under surface 112 of the hub flange 103. Further, there are slide locks 106 and 110 that further secure the toilet flange 101 to the underside of the commode.

Note that the cylindrical, open hub 104 comprises an opening 109. Note that in one embodiment, the opening 109 comprises a valve 111 to ensure water and/or waste does not flow from the channel 102 into the hub flange 103. As will be described further, if there is a leak, water accumulates in the hub flange 103. This water can then escape the hub flange via the opening 109. In this regard, the valve is a one-way valve 111 that allows fluids to exit the hub flange 103.

Further, between the under surface 112 of the hub flange 103 and an outside wall 121 that spans the periphery of the toilet flange 101, is a moisture indicator device 119. For example, device 119 may be a moisture indicator sticker or a liquid submersion indicator.

The moisture indicator device 119 is configured to change colors or other wise indicate the presence of moisture. Thus, without disassembling the commode and the toilet flange 101, the moisture indicator device 119 can let a user know if moisture is present that shouldn't be. This will allow the user to more easily address the moisture problem.

The hub flange 103 further comprises a circular conduit 202. This circular conduit 202 is indirectly coupled to the opening 109 in the wall of the hub 104. If there is a leak, for example a leak due to a faulty wax ring, the moisture indicator device 119 may change colors and water that is accumulating because of the leak indirectly flows from the circular conduit 202 and out the opening 109 in the hub 104. Thus, the water cannot escape to cause flooding or unwanted water.

Figure 2:
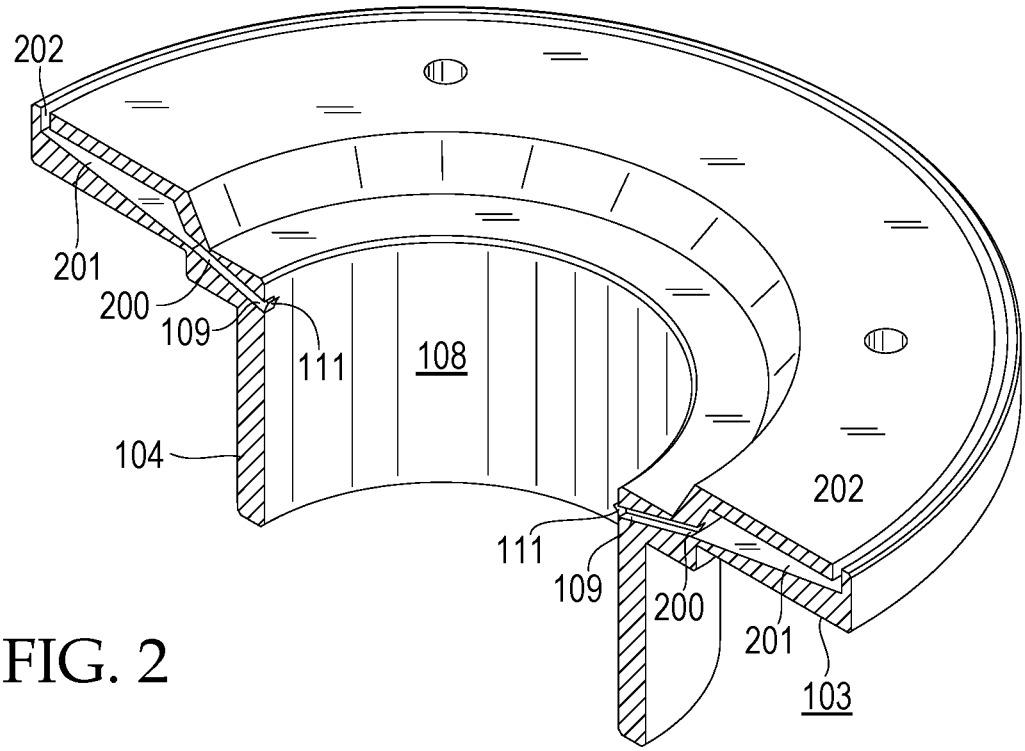
FIG. 2 is a perspective side cutaway view of the toilet flange depicted in FIG. 1.

FIG. 2 is a cross-sectional view of the toilet flange 101 as is depicted in FIG. 1. The hub 104 extends perpendicularly to the hub flange 103. The hub 104 is an open cylinder thereby forming the channel 102 through which waste from a toilet bowl (now shown) may escape when the commode (not shown) is flushed.

The hub flange 103 comprises two sections, which may be integral or separate and coupled together. First, the hub flange 103 comprises a top flange 204 that extends perpendicularly, outwardly and radially from the cylindrical, open hub 104. The top flange 204 is partially hollowed out. In this regard, within the top flange 204 is a reservoir 201 that extends the entire distance around the top flange 204. In one embodiment, the channel 201 is triangle-shaped. However, other shapes are possible in other embodiments.

The reservoir 201 is in fluid communication with the circular conduit 202. This circular conduit 202 extends the circumference of the hub flange 103, extends perpendicular to the reservoir 201 and parallel with the hub 104. Note that this area is where a moisture indicator 119 (FIG. 1) may be coupled to manage and monitor water within circular conduit 202 of the toilet flange 101.

The hub flange 103 further comprises bottom flange 203. The bottom flange 203 has a substantially rectangular cross section and is coupled to the top flange 204; however, the top flange 204 is not flush with the bottom flange 203. Instead, the bottom flange 203 is situated so that the bottom flange 203 is not flush with bottom flange 204.

Within the bottom flange 203 is an angled channel 200. On one end, the angled channel 200 is in fluid communication the reservoir 201. On the other end, the angled channel 200 is in fluid communication with the hub channel 102.

During operation, if there is a leak in the commode, the wax ring, or otherwise, water flows into circular conduit 202. If a moisture indicator is present, then it indicates moisture is present. The water in circular conduit 202 flows into the reservoir 201 in the top flange 204. The water then flows from the reservoir 201, through the channel 200, and out opening 109. Note that 109 has a valve; however, it is positioned to allow fluid flow into the channel 102. It does not, though, allow fluid to flow back up channel 200.

Figure 3:
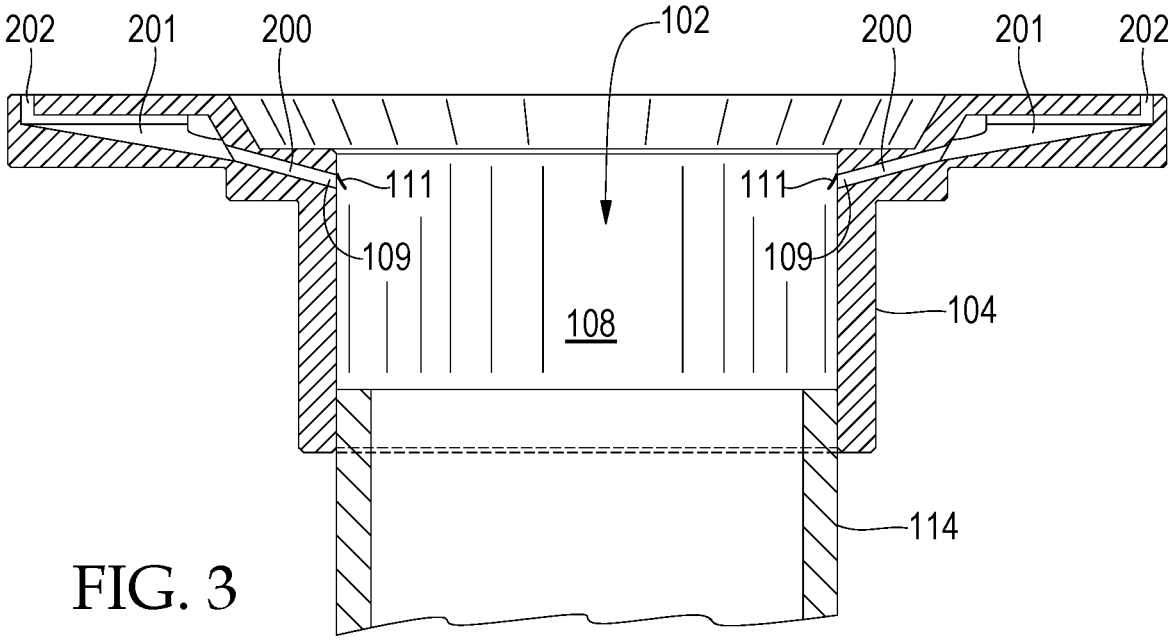
FIG. 3 is a cross-sectional view of the toilet flange depicted in FIG. 1.

FIG. 3 is another cross-sectional view of the toilet flange 101. The hub flange 103 comprises the top flange 204 and the bottom flange 203. Within the top flange 204 is the reservoir 201 and circular conduit 202.

Within the bottom flange 203 is a channel 200. The channel 200 is in fluid communication with the reservoir 201. Further, the channel terminates with an opening 109 that is covered by a one-way valve 111.

The cylindrical, open hub 104 is integral with or coupled to the hub flange 103. The hub 104 comprises an inner wall 108 that forms a conduit through which waste may travel when a commode is flushed.

In operation, the hub flange 103 is coupled to the floor and to the underside of a commode. That is, that portion of the commode from which waste exits the commode when the commode is flushed.

If there is a leak between the hub flange 103 and the commode, water related to the leak will accumulate in circular conduit 202. Water from circular conduit 202 shall travel to the reservoir 201. Water then travels down the channel 200 where the water exits through opening 109, passed valve 11, and into the conduit created by the hub 104.

What is claimed is:

1. A toilet flange, comprising:

a hub configured to couple to a pipe on a first end, the hub having an inner circular wad forming a cylindrical channel and having at least one opening; and a hub flange coupled to the hub on a second end, the flange comprising a reservoir for collecting liquid, the flange further configured to dump the liquid from the reservoir into the cylindrical channel through the opening, wherein the hub flange has an upper surface and a conduit is formed in the upper surface, and, wherein the conduit is configured to collect liquid if there is a leak in a commode.

2. The toilet flange of claim 1, wherein the hub is integral with the hub flange.

3. The toilet flange of claim 1, wherein the conduit comprises a moisture detection device.

4. The toilet flange of claim 1, wherein the conduit is in fluid communication with the reservoir and liquid collected by the conduit flows to the reservoir.

5. The toilet flange of claim 4, further comprising a flange channel in fluid communication with the reservoir.

6. The toilet flange of claim 5, wherein the flange channel is in fluid communication with the opening such that liquid from the conduit, flows through the reservoir, flows through the flange channel and out the opening into the cylindrical channel.

7. The toilet flange of claim 1, wherein the at least one opening is coupled to a valve.

8. The toilet flange of claim 7, wherein the valve is configured to allow water to flow into the cylindrical channel but not into the flange channel.

9. The toilet flange of claim 1, wherein the reservoir extends around the hub flange.

10. The toilet of claim 9, wherein the conduit extends around the hub flange.

11. A toilet flange, comprising:

a cylindrical, open hub having an inner cylindrical wall forming a hub channel for disposing of waste from a commode, further formed in the cylindrical wall is an opening; and a circular flange comprising a top flange and a bottom flange, the circular flange having an upper surface and formed into the upper surface is a conduit configured for collecting liquid, the conduit in fluid communication with a circular reservoir formed inside the top flange, the circular reservoir in fluid communication with at least one channel that empties fluid through the opening into the huh channel.

12. The toilet flange of claim 11, wherein the conduit comprises a moisture indicator device.

13. The toilet flange of claim 11, wherein the opening comprised a valve.

14. The toilet flange of claim 13, wherein the valve is configured to allow fluid out of the opening but not allow fluid into the opening.

* * * * *